United States Patent [19]

Deforeit

[11] 4,384,504

[45] May 24, 1983

[54] METHOD OF AND APPARATUS FOR PHASE SYNCHRONIZATION OF DIGITALLY SYNTHESIZED SIGNALS

[75] Inventor: Christian J. Deforeit, Trossingen, Fed. Rep. of Germany

[73] Assignee: Matth. Hohner AG, Trossingen, Fed. Rep. of Germany

[21] Appl. No.: 273,571

[22] Filed: Jun. 15, 1981

[30] Foreign Application Priority Data

Jun. 24, 1980 [DE] Fed. Rep. of Germany ..... 3023580

[51] Int. Cl.[3] ..... G10H 7/00

[52] U.S. Cl. ..... 84/1.01; 84/1.03; 84/1.17; 324/78 D; 324/79 D; 328/55; 328/155

[58] Field of Search ..... 84/1.01, 1.03, 1.17, 84/DIG. 22; 324/78 R, 78 D, 79 R, 79 D, 82, 83 R, 83 D; 328/55, 72, 155; 364/487

[56] References Cited

U.S. PATENT DOCUMENTS 4,206,414 6/1980 Chapman ..... 328/155

4,279,186 7/1981 Deforeit ..... 84/1.01

*Primary Examiner*—Stanley J. Witkowski

[57] ABSTRACT

The phase of digitally synthesized audio frequency signals of the same frequency is synchronized prior to conversion of the signals into analog form. The phase synchronization is accomplished, in a musical instrument of the keyboard type, by comparison of the digitally coded signals which are commensurate with all of the simultaneously generated input commands and, when frequency coincidence is detected, employing the phase value of the first of plural commanded signal at the same frequency as the starring phase value for subsequently generated signals at the common frequency.

4 Claims, 1 Drawing Figure

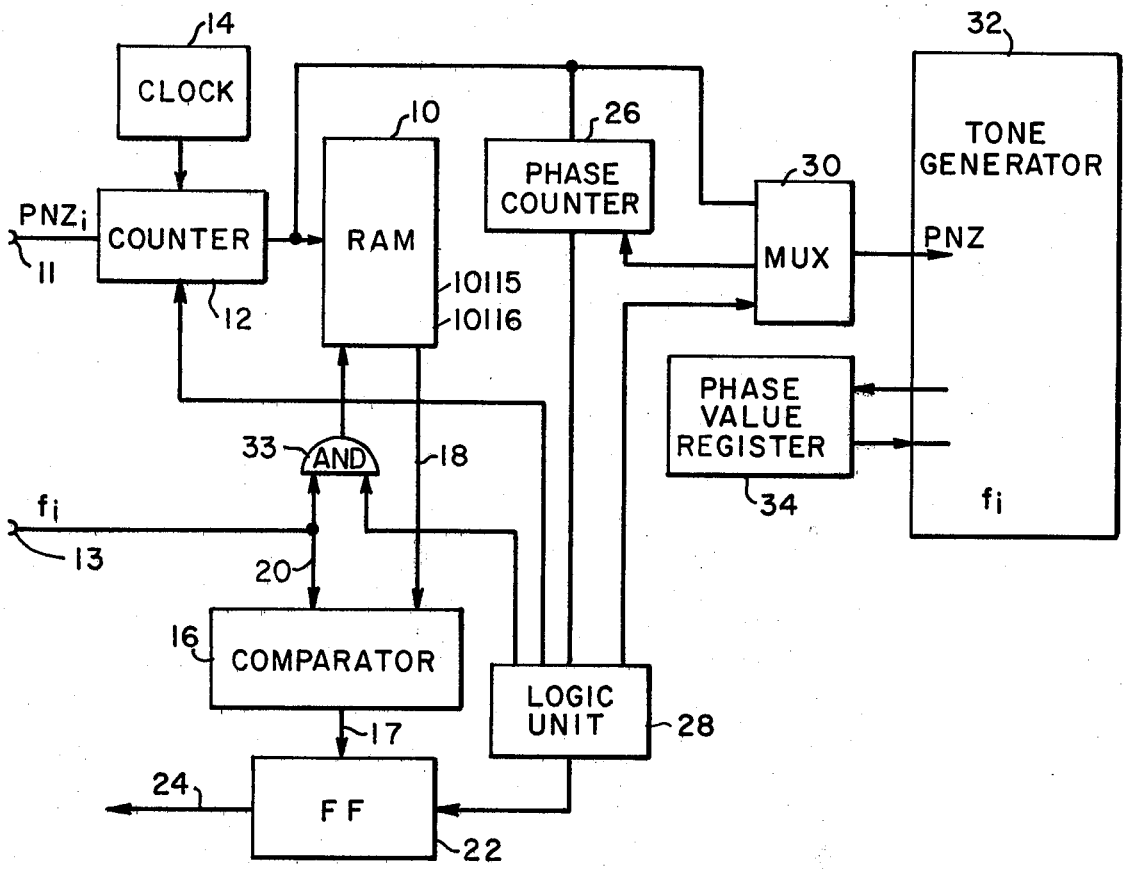
14
CLOCK
10
RAM
26
PHASE COUNTER
30
MUX
32
TONE GENERATOR
PNZ
PNZi
COUNTER
11
12
10115
10116
PHASE VALUE REGISTER
34
fi
33
AND
18
fi
13
20
16
COMPARATOR
17
LOGIC UNIT
28
24
FF
22

METHOD OF AND APPARATUS FOR PHASE SYNCHRONIZATION OF DIGITALLY SYNTHESIZED SIGNALS

BACKGROUND OF THE INVENTION (1) Field of the Invention

The present invention relates to phase synchronization, particularly of digitally synthesized analog signals, and especially to the phase synchronization of signals commensurate with audio tones generated in an electronic musical instrument. More specifically, this invention is directed to circuitry for synchronizing the phase of plural signals of the same frequency when in digital form. Accordingly, the general objects of the present invention are to provide novel and improved methods and apparatus of such character.

(2) Description of the Prior Art

While not limited thereto in its utility, the present invention is particularly well suited for use in electronic musical instruments. Such instruments, keyboard instruments of the electronic organ type for example, were initially analog devices. It is, of course, comparatively easy to synchronize the phase of simultaneously generated analog signals having the same basic frequency. This may, for example, be accomplished through the use of phase regulating loops and such phase regulation circuitry was common in early electronic musical instruments. In many more recent electronic musical instruments, however, the notes are synthesized digitally and each note which can be simultaneously played will have an associated "phase counter". Since the moment sound production commences, i.e., the moment when the musician touches a key, cannot be predicted, there are unforeseeable phase relationships between the individual notes which may be simultaneously produced. As long as the notes are of different basic frequency, these unforeseeable phase relationships are of no great significance to the audio frequency tone which is produced. However, if simultaneously sounded notes have the same basic frequency or the identical frequency, and this may be the case if the same note is simultaneously "struck" on two parallel manuals (keyboards), then interferences occur and these interferences are different depending on the relative times the simultaneously depressed keys are operated.

The problem discussed above could be solved simply by associating with each manual, or with each octave of an instrument, its own complete synthesizing circuit whereby superimposition would take place only after the conventional digital-to-analog converter, i.e., immediately prior to delivery of the analog signal to the sound producer. This solution, however, requires a rather substantial duplication of circuitry and thus adds to the complexity and cost of the instrument.

SUMMARY OF THE INVENTION

The present invention overcomes the above-briefly discussed and other deficiencies and disadvantages of the prior art by providing a method for the phase synchronization of plural digitally synthesized signals having the same basic frequency and commanded within the same time period. In the environment of an electronic musical instrument, in which the notes to be played are synthesized digitally from phase scanning values, the present invention contemplates phase synchronization within the digital circuit which carries out the sound synthesis to thereby significantly reduce the amount of circuitry required to obtain such synchronization.

In apparatus in accordance with the invention information commensurate with the frequency of each note which is simultaneously played is temporarily stored in a memory at a location which has an address corresponding to the instrument's phase counter associated with each simultaneously playable note. The memory locations are constantly scanned and, in the event that a previously stored frequency is commanded while the original command is still present, the momentary phase value of the phase counter which initially commanded the common frequency signal is determined and this phase value is utilized as the starting phase value for the phase counter which subsequently commanded the common frequency signal. At the end of the note the memory location previously occupied by the said common frequency is erased of its contents.

BRIEF DESCRIPTION OF THE DRAWING

The present invention may be better understood and its numerous advantages will become apparent to those skilled in the art by reference to the accompanying drawing which is a block diagram of circuitry in accordance with a preferred embodiment of the invention.

DESCRIPTION OF THE PREFERRED EMBODIMENT

As previously noted, while not limited thereto in its utility the present invention is particularly well suited for the phase synchronization of digitally synthesized notes in a musical instrument. For examples of musical instruments in which the present invention may be employed, reference may be had to U.S. Pat. No. 4,279,186 and co-pending U.S. Pat. application Ser. No. 235,843, filed Feb. 19, 1981.

With reference now to the drawing, an address counter is indicated at 12. In the manner and for the purposes to be described below, counter 12 addresses, at a rate determined by a clock pulse source 14, a random access memory 10. Memory 10 will have a number of locations corresponding to the maximum number notes which can be expected to be played simultaneously on the instrument. In a typical case, an electronic organ may have provision for sixteen simultaneously playable notes and the instrument will thus have sixteen "phase counters". The present invention determines whether, at the commencement of a note, i.e., when the musician depresses a key to close a switch and generate an input command, the instrument is already producing a note having the same basic frequency. Should this be the case, the phase of the second note at this basic frequency will be synchronized with the note which is already being produced. At the end of a note, of course, the circuit must be prepared for the arrival of a subsequent note and, similarly, it must be established whether the instrument is already producing this subsequent note.

Information concerning the identification number of an "occupied" phase counter, the phase counters being part of a tone generator 32 and not shown in the drawing, and the basic frequency with which the phase counter is occupied is fed to the circuit of the present invention in digital form via respective input conductors 11 and 13. This input information will be available to the circuit shown in the drawing as soon as one note generating cycle commences, i.e., as soon as the musician operates a key of a manual, for example.

The address counter 12 has a capacity equal to the number of memory locations in RAM 10 and is initially at 0. Upon initiation of operation of the instrument, and at the frequency determined by clock 14, counter 12 will sequencially address the memory locations of RAM 10. The digital values commensurate with those basic frequencies which the instrument in fact produces may be stored in memory 10. The frequency related digital value commensurate with the memory location which is being addressed will appear, via output conductors 18 of memory 10, at a first input to a comparator 16. The digitally coded information commensurate with the frequency to be generated, as determined by the content of the occupied phase counter being sampled, is applied to a second input 20 of comparator 16. If the two inputs to comparator 16 are equal, the comparator will provide an output trigger pulse to a flip-flop circuit 22 via conductor 17. The trigger pulse provided at the output of comparator 16 will thus set flip-flop 22 whereby a "presence" signal will appear on output 24 of flip-flop 22. This "presence" signal will provide an indication that a sound having the same basic frequency as that being commanded by the pulse counter at that instant providing an input to address counter 12 is already being generated. The flip-flop 22 produces a "presence" signal on its output 24 only under the circumstances described.

Continuing to discuss the operation of the circuit, the address counter 12 counts once through its counting capacity and then returns to zero. At this time the number PNZ of the occupied phase counter appears at the input to address counter 12 and counter 12 thus addresses the memory location of RAM 10 which corresponds to the number of the occupied phase counter. The frequency with which the phase counter is occupied is, via AND gate 33, and under the supervision of an enabling signal provided by a logic unit 28, written into the memory location of RAM 10 which corresponds to the number of the occupied phase counter. The address of the occupied phase counter is also delivered to a phase counter register 26 and, via multiplexer 30, to tone generator 32.

If a second note having the same basic frequency is commanded prior to the original command being removed, a "presence" signal will be provided at the output of flip-flop 22. The generation of the "presence" signal will result from the sequencial scanning of the memory locations of RAM 10 by address counter 12 and the detection, by comparator 16, of the fact that the newly required note has the same frequency as a note which is already being produced. This "presence" signal will cause the phase counter number stored in register 26 to be read out. The phase counter in tone generator 32 which corresponds to the number read out of register 26, i.e., the number of the phase generator which first commanded the signal at the common frequency, is then addressed via the multiplexer 30 and the phase value of the signal therein is read out and written in a phase value register 34. The signal written in phase value register 34 will thereafter be employed as the starting phase value for the phase counter in the tone generator 32 which is subsequently "occupied" by the common frequency. Accordingly, phase counters with which identical base frequencies are associated will be operated in phase synchronism. It will be appreciated that, due to the time pattern of the above-described control system and particularly the inherent internal time delays, the phase location of the two or more phase counters calling for the generation of the same frequency will not be precisely the same. However, any residual phase differences which may be present are so small as to not be detectable by the human ear.

In the manner known in the art in electronic musical instruments, the above-described operations take place under the control of a logic unit 28. The content and operation of logic unit 28 will be known to those skilled in the art and thus a further discussion of this unit is not believed to be required herein.

At the end of each note, the relevant phase counter in the tone generator will be "free". Under the control of the logic unit 28, the number of a free phase counter is transmitted, as a meter reading, to address counter 12 and, through the action of AND gate 33, the contents of the relevant memory location in RAM 10 will be erased. The phase counter can then be utilized by a subsequent note.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A method for the phase synchronization of at least two electrical signals commensurate which are to be transduced into audible tones in an electronic musical instrument, the electrical signals being representative of notes which may have the same basic frequency, the electrical signals being synthesized from digitally coded commands which include phase values, the method comprising the steps of:

sequentially storing at separate locations in a memory information commensurate with the frequency of each command;

comparing the frequency information of each sequentially generated command with the stored frequency information of prior commands;

providing an indication of the frequency coincidence of two commands;

determining the phase value of the initial command at the common basic frequency when a frequency coincidence indication is provided;

employing the phase value of the said initial command as the initial phase value of the subsequently generated command at the common basic frequency; and deleting from storage the frequency information upon termination of the command commensurate therewith.

2. Apparatus for synchronizing the phase of at least two audio frequency signals commensurate with constituent tones of a note which are played in sucession but simultaneously by the user of an electronic musical instrument, the signals to be synchronized having the same basic frequency and being synthesized from digitally coded command signals commensurate with the said tones, the instrument having plural phase counters which provide the digitally coded command signals, the command signals including phase values, said apparatus comprising:

storage means, said storage means having a number of memory locations which at least equals the number of phase counters in the instrument;

means for sequentially addressing the memory locations in said storage means, said addressing means being responsive to identification signals provided by the phase counters and initiating addressing of said storage means upon commencement of a note;

means for delivering the frequency information from the phase counters to said storage means whereby the frequency information is stored at the memory location corresponding to the identity of the phase counter which is commanding the frequency;

digital comparator means, said digital comparator means being connected to said storage means and to said delivering means for comparing the content of the sequentially addressed memory locations with the frequency information inputted from the phase counters, said comparator means generating an output signal when two phase counters simultaneously command a signal at the same basic frequency;

means responsive to the generation of an output signal by said comparator means for providing a signal commensurate with the identity of the phase counter which first commanded a signal at said basic frequency;

multiplexor means for addressing the phase counter, said multiplexor means being responsive to the signal corresponding to the identity of the phase counter which first commanded the signal at the basic frequency for interrogating that phase counter for its phase value; and phase register means responsive to an interrogation of a phase counter by said multiplexor means for storing the phase value of the phase counter which first commanded the said basic frequency signal, said stored phase value being subsequently employed as the initial phase value of the phase counter which is second to command a signal at said basic frequency.

3. The apparatus of claim 2 wherein said means for sequentially addressing said storage means includes:

means for setting the memory location address of said addressing means at the number of the phase counter corresponding to the tone with which the note was commenced.

4. The apparatus of claim 3 further comprising:

means responsive to the end of a note as represented by the removal of a frequency command from the output of the phase counter with which the note was commenced for erasing the frequency information form the storage means memory location corresponding to the said phase counter.

* * * * *